US009091025B2

(12) United States Patent
Voncken

(10) Patent No.: US 9,091,025 B2
(45) Date of Patent: Jul. 28, 2015

(54) METHOD FOR MANUFACTURING A RESIN-IMPREGNATED DECORATIVE PAPER, AND DECORATIVE PANEL

(75) Inventor: Hendrikus Hubertus Gerardus Voncken, Es Elsloo (NL)

(73) Assignee: TRESPA INTERNATIONAL B.V., Weert (NL)

( * ) Notice: Subject to any disclaimer, the term of this patent is extended or adjusted under 35 U.S.C. 154(b) by 502 days.

(21) Appl. No.: 13/255,801

(22) PCT Filed: Mar. 15, 2010

(86) PCT No.: PCT/NL2010/000040

§ 371 (c)(1), (2), (4) Date: Jan. 16, 2012

(87) PCT Pub. No.: WO2010/104380

PCT Pub. Date: Sep. 16, 2010

(65) Prior Publication Data

US 2012/0114918 A1 May 10, 2012

(30) Foreign Application Priority Data

Mar. 13, 2009 (NL) ..... 1036705

(51) Int. Cl.

| | |
|---|---|
| ***C08F 2/46*** | (2006.01) |
| ***C08F 2/48*** | (2006.01) |
| ***D21H 19/20*** | (2006.01) |
| ***D21H 23/72*** | (2006.01) |
| ***D21H 27/26*** | (2006.01) |

(52) U.S. Cl.

CPC ..... *D21H 19/20* (2013.01); *D21H 23/72* (2013.01); *D21H 27/26* (2013.01); *Y10T 156/10* (2015.01); *Y10T 428/24868* (2015.01); *Y10T 428/24934* (2015.01)

(58) Field of Classification Search

None

See application file for complete search history.

(56) References Cited

U.S. PATENT DOCUMENTS

| | | | | |
|---|---|---|---|---|
| 3,789,604 | A | 2/1974 | Hurt | 368/221 |
| 4,151,315 | A | 4/1979 | Fock et al. | 427/258 |
| 4,246,315 | A | 1/1981 | Kopp et al. | 428/315 |
| 4,324,832 | A | 4/1982 | Moroff et al. | 428/289 |
| 4,501,635 | A | 2/1985 | Siry et al. | 156/273.3 |
| 4,579,776 | A | 4/1986 | Fock et al. | 428/332 |
| 4,801,486 | A | 1/1989 | Quacquarella et al. | 428/34.9 |
| 4,801,495 | A | 1/1989 | van der Hoeven | 442/412 |
| 4,927,572 | A * | 5/1990 | van der Hoeven | 264/448 |
| 5,714,269 | A | 2/1998 | Munoz Madrid | 428/500 |
| 7,192,543 | B2 | 3/2007 | Malfliet et al. | 264/45.5 |

FOREIGN PATENT DOCUMENTS

| | | |
|---|---|---|
| DE | 2 224 732 | 12/1973 |
| DE | 2 727 312 | 12/1978 |
| DE | 28 01 396 | 7/1979 |
| DE | 2 903 172 | 8/1980 |
| DE | 3024394 | 1/1982 |
| DE | 3329679 | 1/1985 |
| DE | 3 541 187 | 6/1987 |
| DE | 3 630 315 | 3/1988 |
| DE | 217 252 | 11/1989 |
| DE | 44 13 619 | 6/1995 |
| EP | 0 022 153 | 1/1981 |
| EP | 1 923 211 | 5/2008 |
| GB | 1314329 | 4/1973 |
| NL | 7015324 | 4/1971 |

* cited by examiner

*Primary Examiner* — Sheeba Ahmed

(74) *Attorney, Agent, or Firm* — Roberts & Roberts, LLP

(57) ABSTRACT

The present invention relates to a method for manufacturing a resin-impregnated decorative paper, which method comprises the following steps: i) providing a paper, ii) impregnating the paper obtained in step i) with a first, actinic radiation-curable resin, iii) subjecting the paper obtained after step ii) to a drying step, iv) applying a second, actinic radiation-curable resin to the dried paper obtained after step iii), and v) curing the paper obtained after step iv) to obtain the resin-impregnated decorative paper.

14 Claims, No Drawings

METHOD FOR MANUFACTURING A RESIN-IMPREGNATED DECORATIVE PAPER, AND DECORATIVE PANEL

The present invention relates to method for manufacturing a resin-impregnated decorative paper. The present invention further relates to a decorative panel comprising a substrate, a decorative paper affixed to the substrate and possibly a transparent layer overlying the decorative paper.

A decorative paper or a decorative film is used for decorating plate materials, which plate materials are based mainly on resin-impregnated wood fibres. Such a decorative panel is known from U.S. Pat. No. 3,789,604 and U.S. Pat. No. 4,801,495 in the name of the present applicant. The decorative films known from said US patents are given a structured surface by using a polyester or polypropylene film. Such decorative films are further passed between two rollers, during which passage the structure present on the roller surface is transferred to the decorative film, which means that a repetitive pattern corresponding to the pattern present on the outer surface of the roller(s) will form on the decorative film.

From U.S. Pat. No. 4,927,572 in the name of the present applicant there is known a decorative panel in which a resin-impregnated decorative paper is used, which panel is characterised by a scratch resistance of at least 1.5 Newton and a resistance against weather influences which complies with ASTM G53-84.

From German Offenlegungsschrift DE 44 13 619 there is known a method for manufacturing a decorative paper in which a decorative paper is impregnated with a water-dilutable and electron beam-curable acrylate in the form of a dispersion, an emulsion or a solution, followed by a thermal drying treatment and the application of a coat of varnish, after which curing by means of electron radiation takes place.

From Dutch laid-open publication No. 7015324 there is known a method for curing a curable synthetic resin material, wherein a polymer containing unsaturated groups is used as a coating, which coating is exposed to radiation from an electron beam having an energy of 25-300 kV. Unsaturated polyesters mixed with unsaturated liquid monomers, such as styrene, acrylates or methacrylates, are mentioned as suitable polymers.

German Offenlegungsschrift DE 28 01 396 discloses a method for impregnating a substrate material with a thermally crosslinkable resin, whereupon a thermal treatment is carried out, after which a radiation-curable resin is applied to the surface thus obtained, in which connection in particular acrylate resins are mentioned.

From U.S. Pat. No. 4,501,635 there is known a method in which decorative paper is impregnated with a material based on a ureum formaldehyde resin and an acryl dispersion, followed by a thermal treatment, whereupon a urethane/acrylate based resin is applied, which resin is cured by means of electron radiation.

The process of manufacturing decorative paper by impregnation with a resin, followed by a thermal treatment, is known per se, for example from European patent application EP 0 022 153 and German Patentschrift DE 217 252, in which latter Patentschrift it is explicitly indicated that a decorative paper thus impregnated may additionally be provided with a varnish coating. The following documents can furthermore be mentioned in connection with the impregnation of decorative paper with a resin: German Offenlegungsschrifts Nos. 2 727 312; 2 903 172; 2 224 732; 3 630 315; 3 541 187; 3 329 679 and 3 024 394; European patent publication EP 1 923 211 as well as U.S. Pat. No. 7,192,543.

The present applicant has found that it is desirable in the manufacture of a decorative panel, where a decorative paper is affixed to a substrate and the whole is subsequently placed in a press under high pressure and temperature conditions and pressed together to form the intended decorative panel, that the decorative paper exhibit a good adhesion with the substrate. Because the decorative paper is placed in a press together with the substrate, it is furthermore desirable for the decorative paper to exhibit practically no curling at the edges.

The object of the present invention is thus to provide a method for manufacturing a resin-impregnated decorative paper, wherein delamination problems of the decorative paper in the final decorative panel are minimized.

Another object of the present invention is to provide a method for manufacturing a resin-impregnated decorative paper, which decorative paper will exhibit practically no curling at the edges upon placement in the press.

Yet another object of the present invention is to provide a method for manufacturing a resin-impregnated decorative paper, which decorative paper is processed to form a decorative panel, which decorative panel thus obtained will exhibit a good resistance against weather influences.

The present invention as described in the introduction is characterised in that the method comprises the following steps:

i) providing a paper, ii) impregnating the paper obtained in step i) with a first, actinic radiation-curable resin, iii) subjecting the paper obtained after step ii) to a drying step, iv) applying a second, actinic radiation-curable resin to the dried paper obtained after step iii), and v) curing the paper obtained after step iv) to obtain the resin-impregnated decorative paper.

One or more of the above objects is accomplished by using the above method.

The present inventors have found that it is desirable for step iii) to be carried out to a residual moisture content of <5%, preferably <3%, calculated on the basis of the weight of the paper obtained after the drying step, whilst it is preferable in a special embodiment if the amount of first resin in step ii) is >25 wt. %, preferably >30 wt. %, in particular >35 wt. %, calculated on the basis of the amount of resin applied to the paper. If a residual moisture content of more than 5% is used in step iii), the resin-impregnated decorative paper obtained after step iv) will be sticky, so that it cannot be processed into a roll. Treatment with hot air or with infrared radiation are suitable drying steps. A suitable drying temperature for drying with hot air is 80-200° C. for a period of 30-300 seconds, preferably 30-120 seconds. By applying resin in an amount of at least 25 wt. % in step ii), the paper is substantially fully saturated with resin, which amount of resin is desirable to as to minimize the delamination problems that may occur in the final decorative panel. Furthermore, such an amount of resin is desirable from the viewpoint of resistance to weather influences. Printed paper, in particular having a weight of 15-200 $g/m^2$, more in particular 60-120 $g/m^2$, is suitable for use as the paper in step i).

In step iv) the second, actinic radiation-curable resin is preferably applied in a layer thickness of 15-100 μm, more preferably 25-80 μm, in particular 30-70 μm.

To obtain a strong network in the decorative paper, the first resin preferably comprises a water-based, polyfunctional, unsaturated aliphatic (meth)acrylate compound, whilst also the second resin preferably comprises a polyfunctional, unsaturated aliphatic (meth)acrylate compound. In a special embodiment, the resin used in step ii) may also comprise a thermally curing resin, for example of the melamine-formaldehyde type or of the thermally curable acrylate type, whether or not in the presence of a suitable catalyst, preferably in an amount of at most 50 wt. %, in particular at most 20 wt. %, more in particular at most 10 wt. %, based on the weight of the mixture of actinically curable and thermally curable resin. In particular an oligomer of epoxy and acrylate or silicones and acrylate, preferably an oligomer of polyester and acrylate and in particular an oligomer of urethane and acrylate or the corresponding oligomers of methacrylate can be mentioned as prepolymers, which prepolymers are capable of radiation polymerisation, which have been radiation polymerized, if desired with a mono-, tetra-, penta- and/or hexa-acrylate, preferably a diacrylate or triacrylate for polyols or ether polyols or the corresponding methacrylates. In a special embodiment of the present invention it is desirable that wear-resistant particles or solid fillers be present both in the first and the second resin in an amount of at most 5 wt. %, preferably at most 3 wt. %, in particular at most 1 wt. %.

With a view to obtaining good surface properties of the decorative panel it is furthermore preferable if the prepolymer according to the present invention is an aliphatic oligomer of urethane and acrylate, which has been radiation polymerized with a diacrylate and/or a triacrylate.

To accomplish the above objects, the curing in step v) is preferably carried out in two separate, in time, radiation treatments, using a higher radiation dose in the second treatment than in the first radiation treatment. In this way an initial, incomplete curing is effected in the resin, after which complete curing is effected by means of the second radiation treatment. Such a two-step radiation treatment provides a decorative panel in which the occurrence of delamination problems between the substrate on the one hand and the decorative paper on the other hand is minimized.

In a special embodiment of the present invention it is also possible, on the other hand, to carry out a first radiation treatment after step iii), before step iv) is started, whilst a second radiation treatment according to step v) is carried out after completion of step iv). In such an embodiment it is desirable from a viewpoint of curling behaviour of the decorative paper that the radiation dose used in the first radiation treatment be lower than the radiation dose used in the second radiation treatment. A value of 1-30 kG is a suitable radiation dose for the first radiation treatment, a value of 20-100 kG is a suitable radiation dose for the second radiation treatment.

According to yet another embodiment, step v) is carried out in one single radiation treatment, in which case it is in particular preferable if the temperature used for said treatment is at most 80° C. If a temperature of more than 80° C. is used, a decorative paper thus manufactured will exhibit adhesion problems with the substrate containing cellulose fibres.

In a special embodiment, the resin applied in step iv) preferably comprises at least two separate resin layers, the first resin layer containing pigments and the second resin layer overlying said first resin layer containing one or more components from the group consisting of agents for obtaining the resistance against UV radiation and/or agents for improving the scratch resistance. The first resin layer can be regarded as a layer that is applied first, viz. the layer that abuts against the paper layer. The addition to such a resin layer of one or more additives selected from the group consisting of flame retardants, UV absorbents, light stabilisers, pigments, inorganic particles and agents for improving the scratch resistance, or combinations thereof, makes it possible to give the decorative panel the desired properties, such as a specific colour, scratch and fire resistance, moisture repellence and a reduced sensitivity to harmful UV light.

The present invention further relates to a decorative panel comprising a substrate, a decorative paper affixed to the substrate and possibly a transparent layer overlying the decorative paper, wherein the decorative paper obtained in accordance with the method as described in the foregoing is used, which decorative panel has a resistance to sunlight of at least 4, measured in accordance with ISO 105-AO2 during an exposure period of 5000 hours. The weather resistance is of major importance for outdoor applications. Consequently, it is desirable for the present decorative panel to have an exterior colour stability of at least 4 (measured in accordance with standard testing method ISO 4892-2 and evaluation method ISO 105-A2 with a grey scale). To obtain an improved adhesion behaviour it is desirable in certain embodiments that an intermediate layer be provided between the substrate and the decorative paper, viz. a resin-impregnated paper, in particular a resin of the phenol formaldehyde type.

In addition to that, the present product has been subjected to a test under much severer artificial weather conditions. This additional test is conducted in a closed chamber (Ci4000 Atlas) with a Xenon arch (Xenon lamp of 3500-6500 Watt), carrying out Florida simulation cycles of 120 minutes. Said cycles consist of, successively, 90 minutes light with 50% relative humidity and 30 minutes light with irrigation. The total length of the test is 5000 hours. The light intensity is 0.55 $W/m^2$ at 340 nm, about 63 $W/m^2$ (300-400 nm). The temperature of the air is 50° C. The data thus obtained, as well as the data obtained by using the standard method, were evaluated with ISO 105-A2 with a grey scale. The acceptable colour change, as measured against a reference sample, is a grey scale of at least 4. In addition to that a visual inspection takes place to detect any surface cracks, blisters or delamination.

The delamination behaviour is established upon measurement at the edge of the final decorative panel (visible after 5000 hours).

Layers of papers impregnated with thermosetting resins, in particular soda kraft paper impregnated with phenol formaldehyde resin, can be mentioned as suitable substrate layers. Depending on the desired thickness of the decorative panel, 1 to about 100 layers, arranged on top of one another, are pressed together. The substrate layer may also comprise densified fibre mats composed of, for example, mineral fibres, glass fibres, synthetic fibres or a mixture of fibres, preferably cellulose-containing fibres, such as paper fibres and/or wood fibres. The resin used in the substrate layer is a melamine formaldehyde resin or a phenol formaldehyde resin, preferably of the phenol formaldehyde type.

An optimum adhesion between the decorative paper and the substrate layer is of major importance, in which connection it is preferable if the decorative layer has a Z-strength of at least 2 $N/mm^2$, in particular at least 3 $N/mm^2$ (DIN 52366).

The present invention further relates to a method for manufacturing a decorative panel, wherein an intermediate layer maybe placed between the substrate and the decorative paper, after which the whole is pressed together for 1-30 minutes at a temperature of 100-250° C. and a pressure of 10-100 bar. As a result of said compression the resin of the substrate may penetrate into the decorative paper, so that a region in which the resins of the substrate and the decorative paper impregnate into one another can be observed in the decorative paper.

The present invention will now be explained in more detail by means of a number of examples, in which connection it should be noted, however, that the invention is by no means limited to such special examples.

EXAMPLES 1-13

The table below shows how the decorative paper was manufactured in Examples 1-13 described below. The decorative paper having a paper weight of 82 g/m$^2$ was placed in a press and, using a substrate based on resin-impregnated cellulose fibres, compressed for 20 minutes at a temperature of 160° C. and a pressure of 70 bar.

TABLE

| Parameter | Example 1 | Example 2 | Example 3 | Example 4 | Example 5 | Example 6 | Example 7 |
|---|---|---|---|---|---|---|---|
| Amount of first resin (wt. %) | 35 | 35 | 35 | 27 | 37 | 37 | 35 |
| Moisture content (%) | 1.8 | 1.7 | 1.8 | 1.7 | 1.8 | 1.8 | 5.2 |
| Amount of second resin layer thickness (μm) | 68 | | 68 | | 68 | 68 | not processable into a roll (stickiness) |
| Cure (kG) | 15 | 7 | 50 | 30 | | | |
| Amount of second resin layer thickness (μm) | | 68 | | 68 | | | |
| Cure (kG) | 60 | 60 | 60 | 60 | 60 | 60 | |
| Cure (° C.) | | | | | 75 | 85 | |
| Resin type for impregnating substrate | phenol formal-dehyde | phenol formal-dehyde | phenol formal-dehyde | phenol formal-dehyde | phenol formal-dehyde | phenol formal-dehyde | |
| Adhesion (N/mm2) | 3.5 | 3.2 | 2.1 | 2.2 | 3.5 | 1.8 | |
| Properties of decorative panel, Xenon 5000 hours | | | | | | | |
| Delamination | ++ | + | − | −− | ++ | −− | |
| Grey value | 4/5 | 4/5 | 4/5 | Not measured due to high delamination | 4/5 | Not measured due to high delamination | |

| Parameter | Example 8 | Example 9 | Example 10 | Example 11 | Example 12 | Example 13 |
|---|---|---|---|---|---|---|
| Amount of first resin (wt. %) | 35 | 24 | 20 | 15 | 32 | 37 |
| Moisture content (%) | 1.8 | 1.8 | 1.8 | 1.8 | 1.8 | 1.8 |
| Amount of second resin layer thickness (μm) | 68 | 68 | 68 | 68 | 68 | 68 |
| Cure (kG) | 15 | 15 | 15 | 15 | 15 | 15 |
| Amount of second resin layer thickness (μm) | | | | | | |
| Cure (kG) | 60 | 60 | 60 | 60 | 60 | 60 |
| Cure (° C.) | | | | | | |
| Resin type for impregnating substrate | Melamine formal-dehyde | phenol formal-dehyde | phenol formal-dehyde | phenol formal-dehyde | phenol formal-dehyde | phenol formal-dehyde |
| Adhesion (N/mm2) | 1.8 | 2.5 | 2.5 | 2.5 | 3.6 | 3.5 |
| Properties of decorative panel, Xenon 5000 hours | | | | | | |
| Delamination | −− | − | − | −− | + | ++ |
| Grey value | Not measured due to high delamination | 3/4 | 3 | Not measured due to high delamination | 4/5 | 124 |

In Example 1 the curing of the resin-impregnated decorative paper was carried out after both resins had been applied, with the second resin not being applied until the printed paper treated with the first resin had been subjected to a drying treatment (150° C., 1 minute, hot air). The first resin is of the aqueous acrylic type and the second resin is of the aliphatic urethane acrylate oligomer type. In Example 2a slightly modified method for manufacturing the resin-impregnated decorative paper was used, which method comprises impregnating the printed paper with a first resin, followed by a drying treatment. The drying treatment was followed by a first radiation treatment, whereupon the second resin was applied to the thus radiation-treated decorative paper, followed by a second radiation treatment. In Example 3 the method for manufacturing the resin-impregnated decorative paper according to Example 1 was used. The method for manufacturing a resin-impregnated decorative paper as used in Example 4 is analogous to the method used in Example 2. In Examples 5 and 6, a method analogous to the method used in Example 1 was used, but curing was carried out in a single step at a varying temperature. In the case of a temperature >80° C., an undesirably high degree of delamination was observed (Example 6). In Example 7 the drying treatment was carried out to a residual moisture content of 5.2%. The decorative paper thus obtained exhibited a high degree of stickiness and consequently could not be processed into a roll. This means that further processing was not possible. In Examples 8 and 9 practically the same treatments as in Example 1 were used, but in Example 8 a melamine formaldehyde resin was used for impregnating the substrate, whilst in Example 9 a phenol formaldehyde resin was used. The panel thus obtained according to Example 8 exhibited a very high degree of delamination, which means that it was not possible to determine the grey scale after xenon test. In Example 10 the first resin was applied in an amount of 20 g/m$^2$, which resulted in a grey scale of 3 after exposure to xenon for 5000 hours. In Example 11 a first resin was applied in an amount of 15 g/m$^2$, which value led to very strong delamination, in which connection it should furthermore be noted that it was not possible to measure the grey scale because of excessive delamination. The applied amount of first resin was set at a value of 32 g/m$^2$ in Example 12, resulting in an acceptable delamination behaviour, as well as an acceptable grey scale of 4/5. In Example 13 the amount of first resin was set at 27 g/m$^2$, resulting in a decorative panel without delamination problems, as well as an advantageous grey scale value of 4/5 after exposure to xenon for 5000 hours.

From the above table it follows that it is desirable that the radiation dose used in the second radiation treatment be higher than the radiation dose used in the first radiation treatment. After all, upon closing of the press the aforesaid undesirable curling leads to a high risk of the decorative paper being folded double, which means that the substrate is not covered with the decorative paper over the entire area thereof. From Example 4 it furthermore follows that if the radiation dose used in the first radiation treatment is too high, viz. higher than 10 kG, adhesion problems of the second resin will ensue. The inventors have found that the adhesion of the second resin to the decorative paper that has thus already been subjected to a radiation treatment is insufficient. From Examples 5 and 6 it follows that if the curing of the resin-impregnated decorative paper is carried out in a single step, it is important that such a curing step be carried out at a temperature of at most 80° C. (see Example 5). On the other hand, if a temperature of more than 80° C. is used (see Example 6), undesirable curling of the decorative paper and insufficient adhesion will be observed when the thus produced decorative paper and the cellulose fibre-containing substrate are pressed together, which means that a decorative panel manufactured in this way will exhibit delamination.

From Examples 7-13 it follows that it is desirable with a view to obtaining an acceptable delamination behaviour as well as a grey scale value of 4/5 that the paper impregnated with the first resin be dried to a residual moisture content of less than 5%, preferably less than 3%. It is also been observed that a decorative panel having advantageous properties is obtained if the amount of first resin in step ii) is at least 25 wt. %, preferably at least 30 wt. %, in particular at least 35 wt. %, calculated on the basis of the amount of first resin applied to the paper. In addition to that it follows that the impregnation of the substrate with melamine formaldehyde leads to a decorative panel which will exhibit an undesirable delamination behaviour.

The invention claimed is:

1. A method for manufacturing a resin-impregnated decorative paper which comprises the following steps:

i) providing a paper, ii) impregnating the paper obtained in step i) with a first, actinic radiation-curable resin, iii) subjecting the paper obtained after step ii) to a drying step which is carried out to provide a dried paper having a residual moisture content of <5%, calculated on the basis of the weight of the paper obtained after the drying step, iv) applying a second, actinic radiation-curable resin onto the dried paper obtained after step iii), and v) curing the paper obtained after step iv) to obtain a resin impregnated decorative paper;

wherein the dried paper obtained after step iii) is subjected to a first radiation treatment after step iii), before step iv), and a second radiation treatment is carried out for curing according to step v).

2. The method according to claim 1 wherein the amount of first actinic radiation-curable resin in step ii) is >25 wt. %, calculated on the basis of the amount of resin applied to the paper.

3. The method according to claim 1 wherein in step iv) the second actinic radiation-curable resin is applied in a layer thickness of 15-100 μm.

4. The method according to claim 1 wherein the second actinic radiation-curable resin comprises a polyfunctional, unsaturated aliphatic (meth)acrylate compound.

5. The method according to claim 1 wherein the first actinic radiation-curable resin comprises a water-based, polyfunctional, unsaturated aliphatic (meth)acrylate compound.

6. The method according to claim 1 wherein the curing in step v) is carried out in two separate, in time, radiation treatments, using a higher radiation dose in a second treatment than in a first radiation treatment.

7. The method according to claim 1 wherein the actinic radiation-curable resin applied in step iv) comprises at least two separate resin layers.

8. The method according to claim 7, wherein the first actinic radiation-curable resin layer contains one or more pigments and the second actinic radiation-curable resin layer is overlying said first resin layer and contains agents for obtaining resistance against UV radiation and/or agents for improving scratch resistance.

9. The method according to claim 1 wherein the first actinic radiation-curable resin used in step ii) comprises a thermally curing resin, the amount of thermally curing resin being at most 50 wt. %, based on the weight of the mixture of actinically curable and thermally curable resin.

10. The method according to claim 1, wherein step iii) is carried out to a residual moisture content of <3%, calculated on the basis of the weight of the paper obtained after the drying step.

11. The method according to claim 1, wherein wear-resistant particles and solid fillers are present in the first actinic radiation-curable resin and in the second actinic radiation-curable resin in an amount of at most 5 wt. %.

12. The method according to claim 1, wherein wear-resistant particles and solid fillers are present in the first actinic radiation-curable resin and in the second actinic radiation-curable resin in an amount of at most 3 wt. %.

13. The method according to claim 1, wherein wear-resistant particles and solid fillers are present in the first actinic radiation-curable resin and in the second actinic radiation-curable resin in an amount of at most 1 wt. %.

14. The method according to claim 1 further comprising the subsequent step of forming the resin impregnated decorative paper into a roll.

* * * * *